United States Patent [19]

Baker

[11] 4,269,039

[45] May 26, 1981

[54] ICE RECEPTACLE SUPPORT

[75] Inventor: Cecil J. Baker, Ohio Township. Warrick County, Ind.

[73] Assignee: Whirlpool Corporation, Benton Harbor, Mich.

[21] Appl. No.: 75,524

[22] Filed: Sep. 13, 1979

[51] Int. Cl.[3] ..... F25C 5/18

[52] U.S. Cl. ..... 62/344; 185/27; 211/79; 312/219; 312/311; 312/351

[58] Field of Search ..... 62/137, 344; 312/311, 312/274, 271, 351, 219; 185/27, 32; 248/291; 211/79–82; 298/17 R; 414/548

[56] References Cited

U.S. PATENT DOCUMENTS

| | | | |
|---|---|---|---|
| 1,529,032 | 3/1925 | Meisner et al. | 62/344 |
| 2,674,511 | 4/1954 | Minor | 312/269 |
| 3,009,753 | 11/1961 | Gittins | 312/274 |
| 3,026,079 | 3/1962 | Stack | 248/291 X |
| 3,643,464 | 2/1972 | Hilliker et al. | 62/344 |
| 3,843,223 | 10/1974 | Schneider | 312/274 |
| 4,007,602 | 2/1977 | Maxwell et al. | 62/137 |
| 4,068,892 | 1/1978 | Welch | 298/17 R |
| 4,087,140 | 5/1978 | Linstromberg | 62/344 X |
| 4,095,439 | 6/1978 | Linstromberg | 62/344 |

*Primary Examiner*—William E. Tapolcai, Jr.
*Attorney, Agent, or Firm*—Wegner, Stellman, McCord, Wiles & Wood

[57] ABSTRACT

An ice receptacle support for use in a refrigeration apparatus, such as a freezer, wherein ice bodies are stored in an upwardly opening receptacle. The receptacle is removably carried on a support which is swingably mounted by a front pair of links and a rear pair of links so as to be gravity biased forwardly against a small access door carried in the main door of the freezer. When the small access door is opened, the receptacle swings forwardly as a result of the forward gravity biasing thereof by the supporting link arrangement so as to place the receptacle automatically in an ice access position. The links are arranged to provide a controlled limited force of the gravity biasing so as to effectively avoid undesirable opening of the freezer doors by the gravity biasing force. The front pair of links may be pivotally connected to a front upper portion of the receptacle carrier and the rear pair of links may be pivotally connected to a lower rear portion thereof. The front links include pivotally mounted lower end portions and the rear links include pivotally mounted upper end portions.

31 Claims, 4 Drawing Figures

ICE RECEPTACLE SUPPORT

BACKGROUND OF THE INVENTION

1. Technical Field

This invention relates to ice storage receptacles and in particular to means for swingably mounting ice storage receptacles for self-biased movement to an access position when a closure door of the refrigeration apparatus is opened.

2. Background Art

In U.S. Pat. No. 4,095,439 of William John Linstromberg, which patent is owned by the assignee hereof, an improved movable ice receptacle support means is disclosed. As seen therein, the receptacle is carried on a support which is swingably mounted by a front pair of links and a rear pair of links. The system is arranged to be swung rearwardly and upwardly by the closing of the freezer door and permits the receptacle to swing downwardly into an ice access position as a result of the opening of a small access door in the main freezer door. The gravity biasing of the system causes the receptacle to be biased against the closure door in the retracted position with both doors of the apparatus closed. Each of the pairs of pivotal links swingably mounting the carrier includes an upper end portion pivotally mounted to the cabinet above the receptacle, and a lower end portion pivotally mounted to the carrier at the bottom of the receptacle.

In U.S. Pat. No. 1,529,032, Charles F. Meisner et al show an ice container holder for refrigerators and the like. The receptacle is carried on a pair of links which swing over center in moving from a retracted position within the cabinet to an access position forwardly of the cabinet. The receptacle is biased against a rear stop on the rear wall of the cabinet in the retracted position within the cabinet.

In U.S. Pat. No. 2,674,511, Charles G. Minor shows a refrigerator having a tiltable compartment. A pair of coil springs are provided on a pair of rods to bias the unit towards the closed position.

Donald E. Hilliker et al, in U.S. Pat. No. 3,643,464, show a refrigeration unit having an ice access door wherein the receptacle is connected to the ice access door by a suitable mechanism to draw the receptacle outwardly as an incident of swinging of the door to an open position and to return the receptacle to the storage position when the door is swung to the closed position.

SUMMARY OF THE INVENTION

The present invention comprehends an improved refrigeration apparatus wherein the receptacle is removably carried on a support which is swingably mounted by means of a pair of links in a new and improved manner to provide a controlled outward biasing of the carrier and receptacle.

More specifically, the invention comprehends the provision of a new and improved means for mounting the carrier swingably within the refrigerated cabinet including a front swingable link means pivoted to an upper front portion of the carrier and having a lower pivotal connection to the apparatus cabinet. A rear link includes a lower end portion pivotally connected to a lower rear portion of the carrier and includes an upper end portion pivotally connected to the cabinet above the receptacle.

The rear links may have a vertical extent substantially greater than the vertical extent of the front links.

The front links may pass in an overcenter movement from a position wherein the upper ends thereof are rearwardly of the space directly above the lower ends thereof when the receptacle is in the retracted, or storage, position within the refrigerated space, to a position wherein the upper ends are forwardly of the space above the lower ends of the links when the receptacle is in the ice access position as upon opening of the ice access door.

The rear links support the rear portion of the carrier and receptacle so as to permit the rear portion to swing downwardly to a lowermost position in the ice access position and thereby provide an outward biasing force to the carrier at all times.

The links may be provided with means for effecting an adjusting pivotal relationship thereof to the carrier, and in the illustrated embodiment, the carrier is provided with a plurality of downwardly opening pivot slots for selectively receiving a turned end of the forward links so that the turned end may be selectively horizontally positioned relative to the carrier to accommodate the system for use with a wide range of receptacle configurations and ice capacities.

The swingable mounting system provides a controlled, reduced biasing force effectively assuring the retained closed condition of the ice access door and the main freezer door notwithstanding a biasing of the receptacle thereagainst.

In the ice access position, a stable positioning of the carrier is obtained by the outward biasing force of the front link means balanced by the force of the rear link means which is disposed in its lowermost centered position in this arrangement of the apparatus.

More specifically, the invention comprehends an improved automatic ice maker structure having an upwardly opening ice storage receptacle disposed within a refrigerated space and carried by a swing support means supporting the receptacle for gravity-biased movement from a storage position within the space to an access position providing access to the ice in the receptacle from exteriorly of the space. The swing support includes means for adjusting the same for providing an adjustable amount of gravity biasing of the receptacle.

The swing support may include a first portion supporting the receptacle from below and a second portion supporting the receptacle from above. At least one of the portions may pass through a center position as an incident of movement of the receptacle between the storage and access positions.

The means for adjusting the swinging support may comprise means associated with only one of the two swing support portions. In the illustrated embodiment, the adjusting means is associated with only the front swing support portion.

Thus, the invention comprehends an improved means for controlling the gravity-biased movement of an ice storage receptacle in a refrigeration apparatus wherein an access door provides selective access to the ice stored in the receptacle. The support means is extremely simple and economical of construction while yet providing the highly improved functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
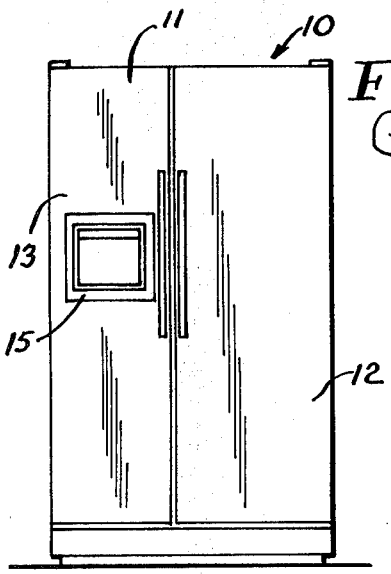
FIG. 1 is a front elevation of a refrigeration apparatus having improved ice storage means embodying the invention.

In the exemplary embodiment of the invention as disclosed in the drawing, a refrigeration apparatus generally designated 10 is shown to comprise a refrigerator-freezer apparatus. Illustratively, the apparatus may comprise a side-by-side unit wherein the freezer portion 11 is disposed at one side of the apparatus and the refrigerator portion 12 is disposed at the opposite side. As shown in FIG. 1, the freezer portion may include a front door 13 for providing selective access to the freezer space 14 (FIG. 2) within the cabinet. Further, as shown in FIG. 1, the freezer door may be provided with a smaller ice access door 15 for selectively closing an opening 17 (FIG. 2) in the main freezer door 13.

Figure 2:
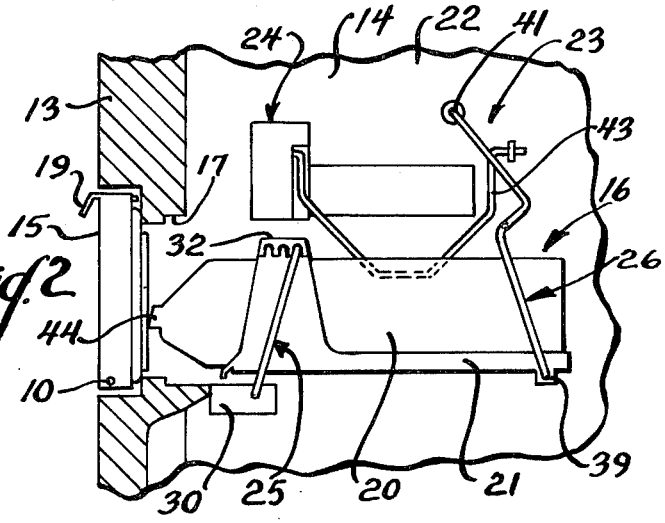
FIG. 2 is a fragmentary vertical section of the refrigeration apparatus illustrating the arrangement of the ice storage means in a retracted storage position within the refrigerated space of the refrigeration apparatus.
Figure 3:
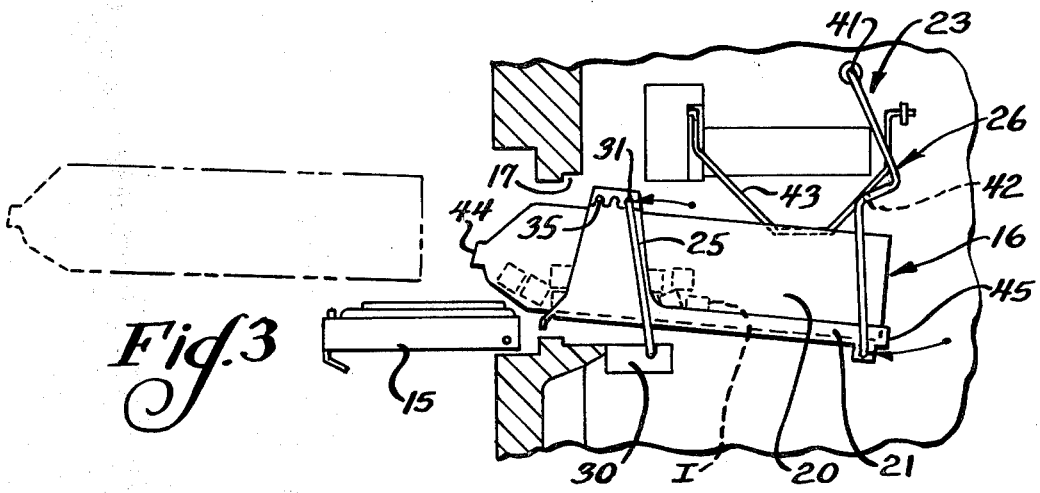
FIG. 3 is a fragmentary vertical section illustrating the arrangement of the ice storage means in full lines as upon opening of the ice access door to provide access to the ice bodies stored in the receptacle which is thusly permitted to move to an ice access position, the receptacle being shown in broken lines as being removed from the carrier support.

As shown in FIG. 2, the ice access door 15 comprises a closure which is pivotally mounted by suitable pivots 18 to the main freezer door 13 and which includes a handle 19 for selectively positioning the access door in a closed position across opening 17, as shown in FIG. 2, and an open position removed from the opening 17, as shown in FIG. 3.

The invention is concerned with means for storing ice bodies, such as ice bodies I illustrated in broken lines in FIG. 3, within the refrigerated space 14 and providing automatic access thereto when either door 13 or door 15 is moved to the open position of FIG. 3. More specifically, the invention comprehends the provision of ice storage means, generally designated 16, comprising an ice storage receptacle 20 which may be removably carried on a support carrier 21. Carrier 21 is swingably carried on the inner cabinet wall 22 of the refrigeration apparatus by a swing support generally designated 23. The swing support is arranged to support the carrier 21 with the receptacle 20 thereon disposed subjacent a conventional automatic ice maker 24 provided within the freezer space 14, so as to receive the formed ice bodies from the ice maker when the receptacle 20 is disposed in a storage position within the space 14, as shown in FIG. 2.

When the closure door 15 is swung to the open position as shown in FIG. 3, the swing support 23 permits the carrier to move forwardly or outwardly into the access opening 17 so as to dispose the receptacle 20 in an ice access position shown in full lines in FIG. 3. In this position, the ice bodies I may be selectively removed from the receptacle 20, or as shown in broken lines in FIG. 3, the entire receptacle may be removed from the carrier 21 through the opening 17, if desired.

Figure 4:
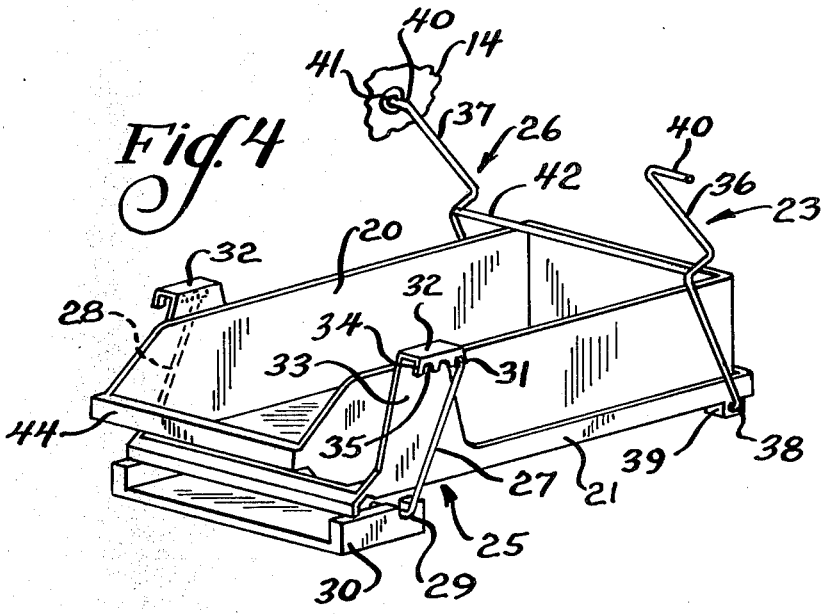
FIG. 4 is a fragmentary isometric view illustrating the receptacle and swing support means therefor in greater detail.

As best seen in FIG. 4, the swing support 23 includes a front first portion 25 supporting the carrier 21 from below and a rear second portion 26 supporting the carrier from above. As shown, the front swing support portion 25 includes a pair of links 27 and 28, one each at opposite sides of carrier 21. The lower end 29 of each of links 27 and 28 is pivotally mounted to a support 30 carried on the cabinet wall 22.

The upper end 31 of each of the arms 27 and 28 is pivotally connected to a pivot portion 32 of the carrier carried on upstanding side flanges 33 thereof.

As best seen in FIG. 4, pivot portions 32 are defined by downturned flanges 34 having a plurality of downwardly opening recesses 35 spaced apart horizontally, i.e. in a fore-and-aft direction relative to the carrier. The pivot portion 31 at the upper end of the arms 27 and 28 defines a turned end portion selectively receivable in any one of the downwardly opening recesses 35 so as to permit adjustment of the pivotal connection of the links 27 and 28 to the carrier in a fore-and-aft direction thereof.

The rear portion 26 of swing support 23 is defined by a pair of links 36 and 37, one each at opposite sides of the carrier and including inturned lower end pivot portions 38 receivable in complemetary pivot portions 39 of the carrier 21. The upper ends of the links 36 and 37 defineturned end pivot portions 40 which may be pivotally connected to suitable pivot sockets 41 carried by the cabinet wall 14. As shown in FIG. 4, a crossbar 42 may be provided between the links 36 and 37 to cooperate with a level sensing detector 43 of the ice maker 24 so as to maintain the ice maker in an "off" condition when an ice receptacle carrier 21 is in the access position of FIG. 3.

As shown in FIG. 4, receptacle 20 defines an upwardly opening receptacle with a partial front wall 44 permitting facilitated access into the receptacle when the receptacle is in the ice access position of FIG. 3.

The improved ice storage means may be utilized with any suitable refrigeration apparatus, and is particularly suited for use with refrigerators having an ice closure door wherein it is desired to selectively position the ice body storage receptacle in a storage position within the freezer space and in an access position at the access opening normally closed by the closure door.

The functioning of the improved receptacle support means herein may be best understood with reference to FIGS. 2 and 3. As shown in FIG. 2, when the freezer door 13 and access door 15 are in the closed position, door 15 bears against the front wall 44 of receptacle 20 urging the storage means 16 to the rearward, storage position. In this position, the links of rear swing support 23 extend downwardly from the top pivot support 41 at a rearward angle to the lower pivots 39. Concurrently, the links of the front portion 25 of swing support 23 extend upwardly at a rearward angle from the lower support 30 to the pivot portions 32 of carrier 21. In this arrangement, the weight of the storage means 16 biases the receptacle 20 against the rear of closure door 15.

When closure door 15 is moved to the open position of FIG. 3, the gravity biasing of storage means 16 causes the storage means to swing forwardly, or outwardly, on swing support 23 to move the front wall 44 of receptacle 20 outwardly through the access opening 17 to provide facilitated access to the ice bodies I therein. In effecting such movement, the links of front swing support portion 25 are swung from the upwardly rearwardly inclined position of FIG. 2 to the upwardly forwardly inclined disposition of FIG. 3 passing through an overcenter position so that the weight of storage means 16 acting through the front link portion gravity biases the storage means forwardly. At the same time, the links of rear swing support portion 26 have swung downwardly from the rearward position of FIG. 2 to a substantially vertical position of FIG. 3 effectively lowering the rear portion 45 of carrier 21 and cooperating with the front swing support portion 25 to maintain the storage means 16 in the illustrated ice access position of FIG. 3.

By suitably positioning the upper pivot portions of the front links 27 and 28 in any one of the pivot recesses 35 of the front carrier pivot support, the storage means is adapted for use with a wide range of different storage receptacles 20 and ice loads. Thus, the outward horizontal force produced by the storage means may be adjusted to provide the desired biasing thereof against the closure door 15 in the closed arrangement of the apparatus, as shown in FIG. 2, while yet providing a positive gravity-biased swingout of the receptacle to the ice access position when door 15 is moved to the open position of FIG. 3. Thus, inadvertent opening of the closure door 15 by excessive outward gravity biasing of storage means 16 is effectively prevented while yet assuring the desired automatic movement to the ice access position.

Improved control of the positioning of the storage means is effected by the effectively opposed horizontal forces developed by the front and rear swing support portions 25 and 26 when the storage means 16 is in the rearward storage position. As will be obvious to those skilled in the art, the unbalanced arrangement of the swinging forces may be effected by reversing the mounting arrangements of the front and rear portions 25 and 26 within the scope of the invention. In such arrangement, the front wall 44 is lowered rather than raised and, thus, may provide further improved accessibility as desired.

It will also be obvious to thos skilled in the art that each of the support portions 25 and 26 could be formed as a single swingable link of various configurations, rather than as a pair of individual links as shown. In addition, the support portions 25 and 26 could be connected directly to the ice receptacle 20, if desired.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having an upwardly opening ice storage receptacle disposed within a refrigerated space, the improvement comprising:

swing support means for supporting the receptacle and applying a horizontally forwardly directed gravity-biased force and a weaker horizontally rearwardly gravity-biased force thereto for causing resultant gravity-biased urging of the receptacle from a storage position within said space to an access position providing access to the ice in the receptacle from exteriorly of said space; and means for providing an adjustable amount of resultant gravity biasing of the receptacle comprising means for adjusting at least one of said gravity-biased forces.

2. In a refrigeration apparatus having an upwardly opening ice storage receptacle disposed within a refrigerated space, the improvement comprising:

swing support means for supporting the receptacle for gravity-biased movement from a storage position within said space to an access position providing access to the ice in the receptacle from exteriorly of said space; and means for adjusting said swing support for providing an adjustable amount of gravity biasing of the receptacle, said swing support including a first portion supporting the receptacle from above and a second portion supporting the receptacle from below.

3. The refrigeration apparatus of claim 2 wherein said swing support includes a first portion supporting the receptacle from above and a second portion supporting the receptacle from below, at least one of said portions passing through a center position as an incident of movement of said receptacle between said storage and access positions.

4. The refrigeration apparatus of claim 3 wherein said adjusting means comprises an adjustable connection between one of said first and second support portions and said receptacle.

5. In a refrigeration apparatus having wall means defining a refrigerated space and having an access opening to said space, an ice storage receptacle within said space, a closure for selectively closing at least a portion of said access opening, the improvement comprising:

a carrier within said space adjacent said closure and carrying said receptacle;

first pivotal supporting means connected between said carrier and a first pivot located above said carrier; and second pivotal supporting means connected between said carrier at a location spaced from said first support and a second pivot located below said carrier, said carrier and said receptacle being moved by gravity to an ice access position upon movement of said closure from said access opening.

6. The refrigeration apparatus of claim 5 wherein the connection of at least one of said supporting means to said carrier comprises an adjustable connection.

7. The refrigeration apparatus of claim 5 wherein said receptacle is removably carried on said carrier.

8. The refrigeration apparatus of claim 5 wherein said supporting means comprise generally vertically extending members.

9. The refrigeration apparatus of claim 5 wherein said supporting means comprise generally vertically extending links pivotally connected to said carrier.

10. In a refrigeration apparatus having wall means defining a refrigerated space and having an access opening to said space, an ice storage receptacle within said space, a closure for selectively closing at least a portion of said access opening, the improvement comprising:

a carrier within said space adjacent said closure and carrying said receptacle;

first pivotal supporting means connected between a first pivot on said carrier and a second pivot located above said carrier; and second pivotal supporting means connected between a third pivot on said carrier at a location spaced from said first pivot and a fourth pivot located below said carrier, said carried receptacle being gravity-biased outwardly against said closure when said closure is disposed to close said access opening and to an ice access position upon movement of said closure from said access opening.

11. The refrigeration apparatus of claim 10 wherein said first pivot is disposed at a rear portion of said carrier.

12. The refrigeration apparatus of claim 10 wherein said third pivot is disposed at a forward portion of said carrier.

13. The refrigeration apparatus of claim 10 wherein said first pivot is disposed at a lower, rear portion of said carrier and said third pivot is disposed at an upper, forward portion of said carrier.

14. The refrigeration apparatus of claim 10 wherein said third pivot is disposed inwardly of the space directly vertical above said fourth pivot when said closure is in the closed position.

15. The refrigeration apparatus of claim 10 wherein said third pivot is disposed inwardly of the space directly vertically above said fourth pivot when said closure is in the closed position and outwardly thereof when the carrier is in the ice access position.

16. The refrigeration apparatus of claim 10 wherein said third pivot comprises a horizontally adjustably positionable pivot.

17. The refrigeration apparatus of claim 10 wherein said third pivot comprises a plurality of horizontally spaced discrete pivot points.

18. In a refrigeration apparatus having wall means defining a refrigerated space and having an access opening to said space, ice storage means within said space, a closure for selectively closing at least a portion of said access opening, the improvement comprising:

first pivotal supporting means connected between said ice storage means and a first pivot located above the level at which said first supporting means is connected to said storage means; and second pivotal supporting means connected between said ice storage means at a location spaced from said first support and a second pivot located below the level at which said second supporting means is connected to said storage means, said storage means being moved by gravity to an ice access position upon movement of said closure from said access opening.

19. A gravity-biased carrier device comprising:

a carrier defining a rear portion and a front portion;

a rear swingable support having a lower portion pivotally mounted to said rear portion and an upper portion pivotally mounted above said support lower portion; and a front swingable support having an upper portion pivotally mounted to said carrier front portion and a lower portion pivotally mounted below said support upper portion, the pivotal mountings of said swingable supports being positioned to cause said support to be gravity-biased forwardly to a preselected access position.

20. The storage device of claim 19 wherein said upper portion of the front support is disposed forwardly of the space vertically above said lower portion thereof when said carrier is in the access position.

21. The storage device of claim 19 wherein said upper portion of said front support is disposed forwardly of the space vertically above said lower portion thereof when said carrier is in the access position and is disposed rearwardly of said space as an incident of a rearward movement of the carrier to a preselected retracted position.

22. The storage device of claim 19 wherein said upper portion of the front support is disposed forwardly of the space vertically above said lower portion thereof when said carrier is in the access position and is disposed rearwardly of said space as an incident of a rearward movement of said carrier to a preselected retracted position, said lower portion of the rear support being disposed rearwardly of the space vertically below said upper portion of the rear support when said carrier is in said retracted position.

23. The storage device of claim 19 wherein said upper portion of the rear support is spaced substantially above the level of said upper portion of said front support.

24. The storage device of claim 19 wherein said front swingable support connects to said carrier at a level above the level at which said rear swingable support connects to said carrier.

25. The storage device of claim 19 wherein at least one of said carrier front portion and said front support upper portion is provided with a plurality of horizontally spaced pivot portions and the other of said carrier front portion and said front upper support portion includes a complementary pivot portion selectively engageable with any one of said spaced pivot portions.

26. The storage device of claim 19 wherein said rear support has a length substantially greater than said front support.

27. In a refrigerator apparatus having wall means defining a refrigerated space and ice storage means movable between a storage position within said space and an access position forwardly of said space, the improvement comprising:

swing support means connected to said ice storage means and arranged to provide a first biasing force urging said ice storage means toward said access position when said ice storage means is in said storage position; and means for providing a second biasing force acting in a direction generally opposite said first biasing force provided by said swing support means when said ice storage means is in its storage position, said second biasing force having a magnitude less than said first biasing force to permit said ice storage means to be urged from said storage position toward said access position with a resultant decreased force.

28. In a refrigeration apparatus having wall means defining a refrigerated space and ice storage means movable between a storage position within said space and an access position, the improvement comprising:

first support means connected to said ice storage means and providing a first, forward biasing force urging said ice storage means toward said access position; and second support means connected to said ice storage means and arranged to provide a second, rearward biasing force urging said storage means toward said storage position, said first biasing force being greater than said second biasing force when said receptacle is in said storage position.

29. The refrigeration apparatus of claim 28 wherein said second biasing force decreases in magnitude as said ice storage means moves from said storage position toward said access position.

30. The refrigeration apparatus of claim 29 wherein said second biasing force changes to a forwardly biasing force as a result of a preselected movement of said ice storage means forwardly from said storage position.

31. The refrigeration apparatus of claim 29 wherein said second biasing force changes to a forwardly biasing force and said first biasing force changes to a rearward biasing force as a result of a preselected movement of said ice storage means forwardly from said storage position.

* * * * *